United States Patent [19]

Raiche

[11] Patent Number: 4,628,849

[45] Date of Patent: Dec. 16, 1986

[54] STITCHED ASSEMBLY

[76] Inventor: Réjean Raiche, 1115 Gascon Street, Chambly, Province of Quebec, Canada, J3L 2T8

[21] Appl. No.: 596,502

[22] Filed: Apr. 3, 1984

[51] Int. Cl.[4] ..... D05B 1/20; B23B 7/08

[52] U.S. Cl. ..... 112/414; 112/427; 112/428

[58] Field of Search ..... 112/414, 427, 428, 438, 112/440, 441, 413

[56] References Cited

U.S. PATENT DOCUMENTS 1,610,652 12/1926 Bouchard ..... 112/414 X 4,479,449 10/1984 Raiche ..... 112/312

OTHER PUBLICATIONS

Federal Standard No. 751a, Jan. 25, 1965, Stitch Types 515 and 518.

*Primary Examiner*—Wm. Carter Reynolds

[57] ABSTRACT

A stitched assembly of a gathered fabric sandwiched between an overlying straight fabric and an underlying elastic strip. The stitch is a chain stitch with the loops of the looper thread directly applied against the elastic strip. The edges of the two fabrics may be joined by an overlock stitch effected in the same sewing operation.

6 Claims, 3 Drawing Figures

STITCHED ASSEMBLY

FIELD OF THE INVENTION

The present invention relates to a stitched assembly in which a gathered fabric, a straight or ungathered fabric and a strip are joined by a sewing machine stitch.

BACKGROUND OF THE INVENTION

The stitched assembly disclosed herein can be obtained through the use of applicant's patent entitled: "SEWING MACHINE" bearing U.S. Pat. No. 4,479,449 and issued Oct. 30, 1984. In this patent, there is embodied a modified sewing machine capable of performing in one operation the two heretofore separate procedures which were as follows:

(1) gathering the waist of a skirt, sleeve or the like; first fabric and retaining the gathered condition by a first line of stitching; and (2) stitching the first fabric to a second fabric, such as a corsage and also to an elastic or non-elastic strip, which is applied directly to the first-gathered fabric.

When the strip is elastic, it can be sewn to the two fabrics under any suitable tension.

Briefly summarized the sewing machine of my U.S. Pat. No. 4,479,449 comprises a sewing machine provided with first differential second feed dogs adapted to catch and gather the first fabric and feed both fabric past the sewing needle. A guide device projecting angularly above the throat plate of the machine ensures that the second fabric will be fed steadily overlyingly the first fabric without being gathered by the front feed dogs. The throat plate is formed with a longitudinal forward groove adapted to guide the strip below the fabric being gathered. This guiding groove has no feed dogs to ensure that the strip is not in contact with gathering dogs. Therefore, the strip is not gathered itself while being stitched in the simultaneous operation.

It is known to stitch two pieces of fabric together, one gathered and the other straight or ungathered, with an elastic strip stitched to the two pieces of fabric. The disadvantage of such sewing resides in the fact that two separate operations have till now been necessary in order that the resulting stitched assembly complies with the aesthetic requirements of the trade. For instance, to sew the gathered top edge of a skirt to the ungathered lower edge of a corsage together with an elastic strip at the junction of the two pieces of fabric, the elastic strip must overlie the gathered fabric and not the ungathered fabric, otherwise the elastic strip would cause an unaesthetic and totally-unacceptable bulge in the corsage. The known manner is therefore first to gather and sew the top edge of the skirt in a first sewing operation and then sew the corsage and strip to the gathered skirt in a second sewing operation with the gathered skirt on top of the corsage and the elastic strip on top of the skirt. With this known manner, it is also very difficult to match the pattern of the two pieces of fabric. Moreover, since such separate operations are time-consuming and costly, it would be very desirable to have a stitched assembly in which the strip, the gathered fabric and the ungathered fabric are stitched together by a single line of stitching, with the strip directly applied to the gathered fabric.

OBJECTS OF THE INVENTION

In view of the above, it is the object of the present invention to provide a stitched assembly of a strip, elastic or not, and two fabrics, one gathered and the other ungathered, wherein the three pieces are joined by a single line of stitching.

It is another object of the invention to provide a stitched assembly of the character described, wherein the edges of the two fabrics are joined by standard overlock stitching in the same sewing operation.

SUMMARY OF THE INVENTION

The stitched assembly of the invention comprises a first gathered fabric, a second ungathered fabric and a strip retained together by a single sewing machine chain stitch, with the strip directly applied to said gathered tissue; said chain stitch including a sewing needle thread and a looper thread; the loops of said loop thread directly applied against said strip and retaining the latter against said gathered fabric. The chain stitch is also called a safety stitch and is identified as Federal Standard Stitch type 401. This stitch exhibits the required stretch capability.

Preferably also, the edges of the two fabrics are joined in the same sewing operation by a second standard overlock stitch such as Federal Standard Stitch type 503.

The chain stitch is laterally spaced from the overlock stitch.

BRIEF DESCRIPTION OF THE DRAWINGS

The above will be more fully understood by having referral to the following description of the preferred embodiment, illustrated by way of the accompanying drawings, in which.

Like numerals designate like elements in all the drawing figures.

DETAILED DESCRIPTION OF THE PREFERRED EMBODIMENT

Figure 1:
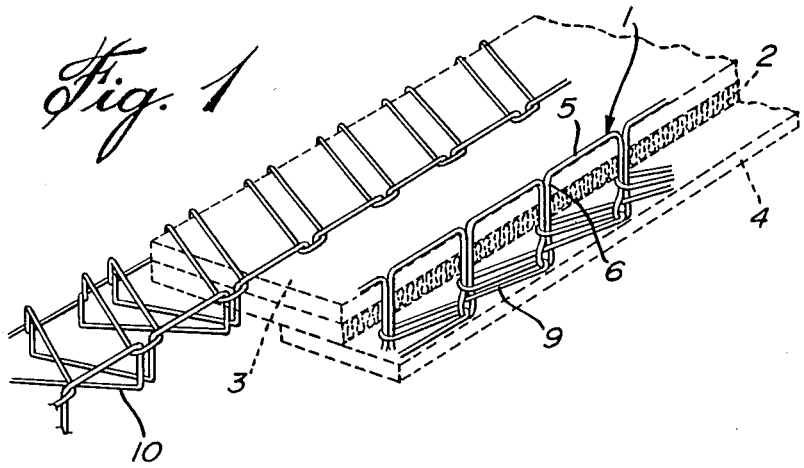
FIG. 1 is a perspective view of the invention showing the two fabric and elastic band in dashed outline.
Figure 2:
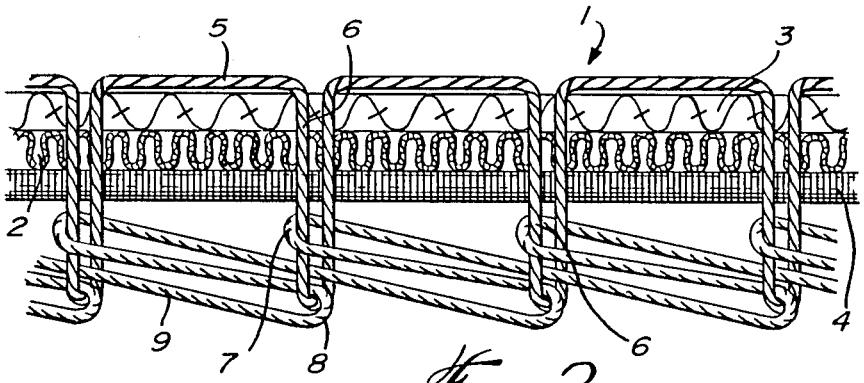
FIG. 2 is a longitudinal section of the assembly, at the level of the chain stitch showing the stitched assembly fully stretched, before the elastic band has contracted to cause the underlying fabric to gather further and the overlying fabric to begin to gather.

FIG. 2 clearly shows the stitched assembly 1 consisting of a first gathered fabric 2, an overlying straight fabric 3 and an underlying elastic band 4. Assembly 1 includes a continuous sewing needle thread 5 having vertical loops 6 passing through fabrics 2, 3 and elastic band 4 at spaced intervals. The lower portion of each loop 6 is interlocked twice at 7 and 8 with a single continuous lower thread 9, forming loops directly applied against band 4. The result is a chain stitch identified as Federal Standard Stitch type 401 and this stitch is hereinafter termed a sewing machine gathering stitch in the sense that the sewing machine effecting this stitch has a mechanism to effect gathering of the fabric 2 during the sewing operation. Thus, elastic band 4 is sewn on the same side of gathered fabric 2 at interlocking points 7 and 8. Elastic band 4 is sewn under a small predetermined longitudinal tension so that band 4 will produce folds in the two stitched fabrics in the area of the stitch once the stitched assembly is released from the sewing machine.

Figure 3:
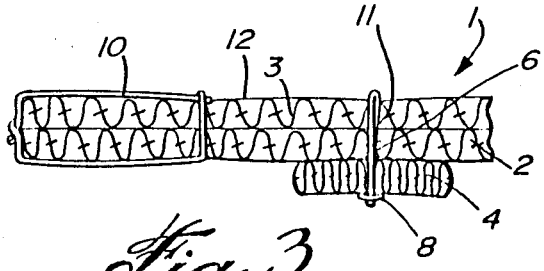
FIG. 3 is a cross-sectional view of the stitched assembly of the invention.

FIG. 3 shows how the edges of tissues 2 and 3 are joined by a standard overlock stitch 10, namely Federal Standard Stitch type 503, to prevent fraying of the edges. FIG. 3 also shows the lateral spacing of the two stitches which are normally effected in a single sewing operation using an overlock sewing machine.

Once sewn, the two fabrics are folded away from each other at 11 to hide elastic band 4, such that the overlock stitch 10 and the adjacent portion 12 of the two fabrics, along with band 4, are on the inside of a textile article, such as a garment.

What I claim is:

1. A stitched assembly comprising a gathered fabric, an ungathered fabric and a strip retained together by a single sewing machine gathering stitch; said gathered fabric being sandwiched between said strip and said ungathered fabric; said stitch being a chain stitch identified as Federal Standard Stitch 401 and including a needle thread and a looper thread, the loops formed by said looper thread directly applied against said strip and retaining the latter against said gathered fabric, said gathered fabric being devoid of any gathering stitch other than said single sewing machine gathering stitch.

2. The stitched assembly of claim 1 wherein the longitudinal edges of said gathered and said ungathered fabrics are joined by an overlock stitch, said chain stitch being laterally spaced from the latter.

3. The stitched assembly of claim 1 wherein said strip is an elastic strip which, when released, produces folds in the fabrics of said assembly in the area of said stitch.

4. The stitched assembly of claim 2 wherein said strip is an elastic strip which, when released, produces folds in the fabrics of said assembly in the area of said chain stitch.

5. The stitch assembly of claim 2 wherein said ungathered fabric is a corsage or bodice and said gathered fabric is a skirt.

6. The stitch assembly of claim 5 wherein said strip is an elastic strip which, when released, produces folds in the fabrics of said assembly in the area of said chain stitch.

* * * * *